US009399232B2

(12) United States Patent
Hasselschwert

(10) Patent No.: US 9,399,232 B2
(45) Date of Patent: Jul. 26, 2016

(54) ELECTROSTATIC SPRAY TOOL SYSTEM

(71) Applicant: Carlisle Fluid Technologies, Inc., Charlotte, NC (US)

(72) Inventor: Daniel J. Hasselschwert, Sylvania, OH (US)

(73) Assignee: Carlisle Fluid Technologies, Inc., Charlotte, NC (US)

( * ) Notice: Subject to any disclaimer, the term of this patent is extended or adjusted under 35 U.S.C. 154(b) by 153 days.

(21) Appl. No.: 14/250,228

(22) Filed: Apr. 10, 2014

(65) Prior Publication Data

US 2014/0312149 A1 Oct. 23, 2014

Related U.S. Application Data

(60) Provisional application No. 61/813,135, filed on Apr. 17, 2013.

(51) Int. Cl.

| | |
|---|---|
| ***B05B 5/00*** | (2006.01) |
| ***B05B 5/03*** | (2006.01) |
| ***B05B 1/00*** | (2006.01) |
| ***B05B 5/025*** | (2006.01) |
| ***B05B 9/01*** | (2006.01) |
| ***B05B 5/043*** | (2006.01) |

(Continued)

(52) U.S. Cl.

CPC . *B05B 5/03* (2013.01); *B05B 1/005* (2013.01); *B05B 5/0255* (2013.01); *B05B 5/043* (2013.01); *B05B 5/053* (2013.01); *B05B 5/0533* (2013.01); *B05B 9/01* (2013.01); *B05B 12/002* (2013.01)

(58) Field of Classification Search

CPC ..... B05B 5/03; B05B 5/053; B05B 12/002; B05B 5/0255; B05B 5/043; B05B 5/0533; B05B 1/005; B05B 9/01

USPC ..... 239/690, 690.1, 704, 706, 707, 708, 239/417.3, 526, 527

See application file for complete search history.

(56) References Cited

U.S. PATENT DOCUMENTS 4,120,016 A * 10/1978 Hendricks ..... B05B 5/043 239/690.1
4,441,656 A 4/1984 Huber
4,653,696 A 3/1987 Rath et al.

(Continued)

FOREIGN PATENT DOCUMENTS

DE 3545885 C1 3/1993
EP 0157199 A2 10/1985

(Continued)

OTHER PUBLICATIONS

PCT Search Report and Written Opinion for PCT/US2014/033858, mailed on Jul. 23, 2014.

*Primary Examiner* — Steven J Ganey
(74) *Attorney, Agent, or Firm* — Fletcher Yoder P.C.

(57) ABSTRACT

A system including an electrostatic tool including a handle, a first trigger configured to move between a first trigger position and a second trigger position, wherein the electrostatic tool is configured to be inactive when the first trigger is in the first trigger position and to spray a coating material when the first trigger is in the second trigger position, an electrostatic activation system configured to activate and deactivate electrical charging of the coating material, and wherein the first trigger and the electrostatics activation system may be separately and simultaneously engaged with a single hand.

24 Claims, 5 Drawing Sheets

(51) Int. Cl.
*B05B 5/053* (2006.01)
*B05B 12/00* (2006.01)

(56) References Cited

U.S. PATENT DOCUMENTS 4,750,676 A 6/1988 Huber et al.
4,752,034 A * 6/1988 Kuhn ..... B05B 5/0531 239/690
4,993,645 A 2/1991 Buschor
5,022,590 A 6/1991 Buschor
6,467,705 B2 * 10/2002 Robidoux ..... B05B 5/005 239/690.1
2011/0210192 A1 * 9/2011 Seitz ..... B05B 5/0531 239/690

FOREIGN PATENT DOCUMENTS

EP 0275913 A2 7/1988
EP 0676242 A2 10/1995
FR 1360743 A 5/1964

* cited by examiner

ELECTROSTATIC SPRAY TOOL SYSTEM

CROSS-REFERENCE TO RELATED APPLICATION

This Application is a Non-Provisional Application and claims priority to U.S. Provisional Patent Application No. 61/813,135, entitled "Electrostatic Spray Tool System", filed Apr. 17, 2013, which is herein incorporated by reference.

BACKGROUND

The invention relates generally to an electrostatic spray tool.

Electrostatic spray tools output sprays of electrically charged materials to more efficiently coat objects. For example, electrostatic tools may be used to paint objects. In operation, a grounded target attracts electrically charged materials sprayed with compressed air from an electrostatic tool. As the electrically charged material contacts the grounded target, the material loses the electrical charge. Unfortunately, the electric charge on the electrically charged material may block or inhibit spraying operations in tight spaces (e.g., corners).

BRIEF DESCRIPTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment a system, including an electrostatic tool including a handle, a first trigger configured to move between a first trigger position and a second trigger position, wherein the electrostatic tool is configured to be inactive when the first trigger is in the first trigger position and to spray a coating material when the first trigger is in the second trigger position, an electrostatic activation system configured to activate and deactivate electrical charging of the coating material, and wherein the first trigger and the electrostatics activation system may be separately and simultaneously engaged with a single hand.

In another embodiment a system, including an electrostatic tool including a handle, a first trigger configured to move between a first trigger position and a second trigger position, wherein the electrostatic tool is configured to be inactive when the first trigger is in the first trigger position and to spray a coating material when the first trigger is in the second trigger position, an electrostatic activation system coupled to the first trigger, and wherein the electrostatic activation system is configured to activate and deactivate electrical charging of the coating material, and wherein the first trigger and the electrostatics activation system may be separately and simultaneously engaged with a single hand.

In another embodiment a system, including an electrostatic tool including a handle, a first trigger configured to move between a first trigger position and a second trigger position, wherein the electrostatic tool is configured to be inactive when the first trigger is in the first trigger position and active when the first trigger is in the second trigger position, an electrostatic activation system coupled to the handle, and wherein the electrostatic activation system is configured to activate and deactivate electrical charging of the coating material, and wherein the first trigger and the electrostatics activation system may be separately and simultaneously engaged with a single hand.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The present disclosure is generally directed to an electrostatic tool system capable of electrically charging a material sprayed with a compressed gas, such as air. More specifically, the disclosure is directed towards an electrostatics activation system that enables an operator to selectively apply an electrostatic charge to a coating material with a single hand. For example, while continuously spraying a coating material, an operator may alternate between adding and removing an electrical charge to the coating material. In some embodiments, the electrostatics activation system may include an electrostatics trigger that activates the electrostatics independently of a main trigger for spraying the coating material. The electrostatics trigger may be coupled to the main trigger enabling an operator to activate and deactivate the electrostatics with a single hand and without removing visual contact from a target. In other embodiments, the electrostatics activation system may include a plunger mechanism that enables an operator to activate and deactivate the electrostatics without removing visual contact from a target. The ability to hold an electrostatic tool and selectively turn the electrostatics on and off with a single hand enables an operator to continuously spray different objects and locations. For example, some objects may have a geometry (e.g., corners) that impedes coating using electrostatics. Accordingly, during continuous spraying operations, an operator may alternate between spraying a coating material with an electric charge and spraying the coating material without an electric charge.

Figure 1:
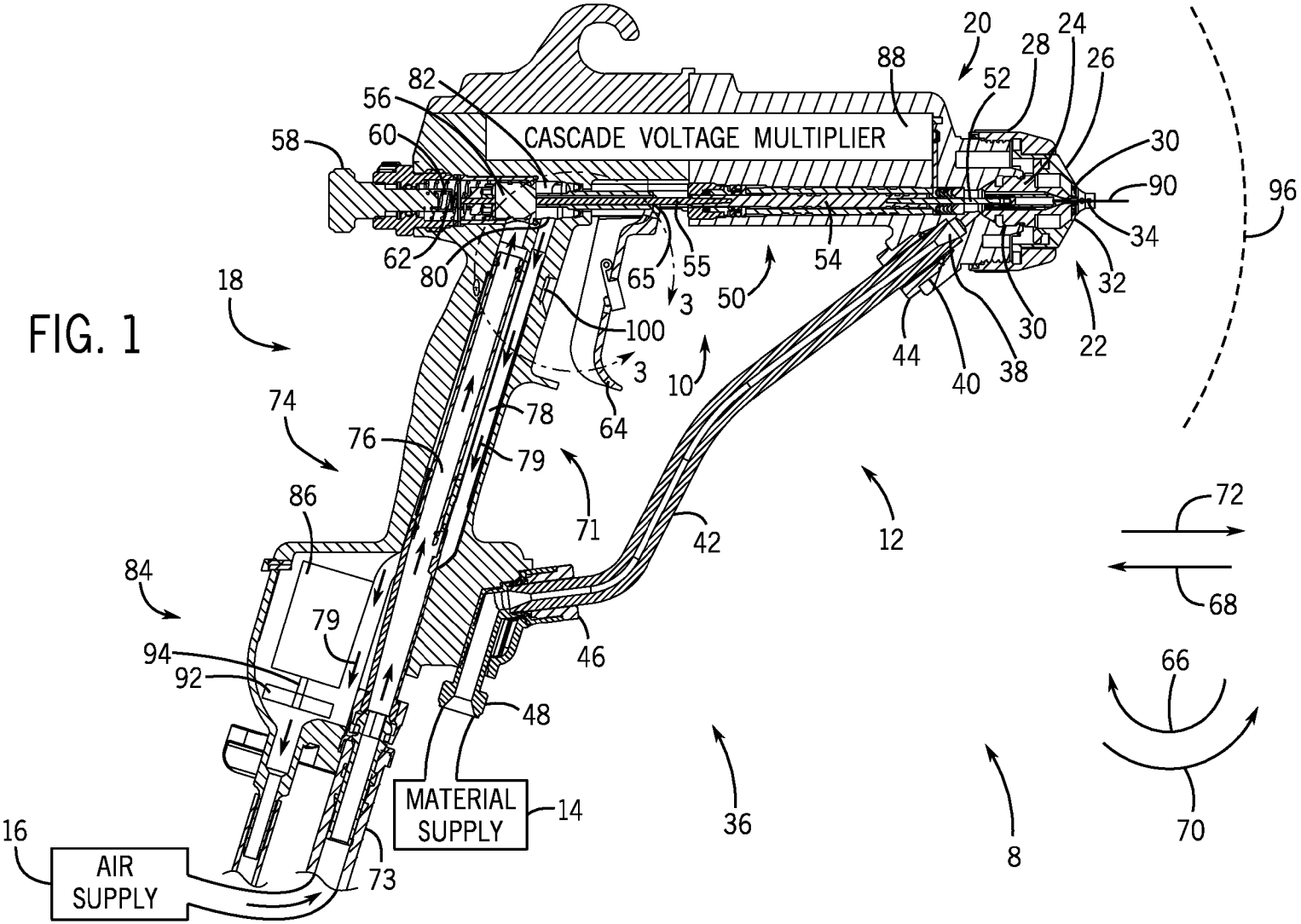
FIG. 1 is a cross-sectional side view of an electrostatic tool system with an electrostatics activation system according to an embodiment.

FIG. 1 is a cross-sectional side view of an electrostatic tool system 8 with an electrostatic activation system 10. The electrostatics activation system 10 enables an operator to selectively apply electric charge or to remove electric charge from a material sprayed by an electrostatic tool 12. As illustrated, the electrostatic tool system 8 includes an electrostatic tool 12 configured to electrically charge and spray a material (e.g., paint, solvent, or various coating materials) towards an electrically attractive target. The electrostatic tool 12 receives sprayable material from a material supply 14, and the electrostatic tool 12 sprays the material with compressed air from an air supply 16.

As illustrated, the electrostatic tool 12 includes a handle 18, a barrel 20, and a spray tip assembly 22. The spray tip assembly 22 includes a fluid nozzle 24, an air atomization cap 26, and retaining ring 28. The fluid nozzle 24 may be removably inserted into a receptacle 30 of the barrel 20. As illustrated, the air atomization cap 26 covers the fluid nozzle 24, and is removably secured to the barrel 20 with the retaining ring 28. The air atomization cap 26 includes a variety of air atomization orifices, such as a central atomization orifice 30 disposed about a liquid tip exit 32 from the fluid nozzle 24. The air atomization cap 26 may also have one or more spray shaping air orifices, such as spray shaping orifices 34 that use air jets to force the spray to form a desired spray pattern (e.g., a flat spray). The spray tip assembly 22 may also include a variety of other atomization mechanisms to provide a desired spray pattern and droplet distribution.

The electrostatic tool 12 includes a variety of controls and supply mechanisms for the spray tip assembly 22. As illustrated, the electrostatic tool 12 includes a liquid delivery assembly 36 having a liquid passage 38 extending from a liquid inlet coupling 40 to the fluid nozzle 24. Included in the liquid delivery assembly 36 is a liquid tube 42. The liquid tube 42 includes a first tube connector 44 and a second tube connector 46. The first tube connector 44 couples the liquid tube 42 to the liquid inlet coupling 40. The second tube connector 46 couples the liquid tube to the handle 18. The handle 18 includes a material supply coupling 48, enabling the electrostatic tool 12 to receive material from the material supply 14. Accordingly, during operation, the material flows from the material supply 14 through the handle 18 and into the liquid tube 42, where the material is transported to the fluid nozzle 24 for spraying.

In order to control liquid and air flow, the electrostatic tool 12 includes a valve assembly 50. As will be explained in more detail below, the valve assembly 50 simultaneously controls liquid and air flow as the valve assembly 50 opens and closes. The valve assembly 50 extends from the handle 18 to the barrel 20. The illustrated valve assembly 50 includes a fluid nozzle needle 52, a shaft 54, and an air valve needle 55, which couples to an air valve 56. The valve assembly 50 movably extends between the liquid nozzle 24 and a liquid adjuster 58. The liquid adjuster 58 is rotatably adjustable against a spring 60 disposed between the air valve 56 and an internal portion 62 of the liquid adjuster 58. The valve assembly 50 couples to a trigger 64 at point 65 (e.g., a pivot joint), such that the fluid nozzle needle 52 of the valve assembly 50 moves inwardly and away from the fluid nozzle 24 as the trigger 64 rotates in a clockwise direction 66. As the fluid nozzle needle 52 retracts, fluid begins flowing into the fluid nozzle 24. Likewise, when the trigger 64 rotates in a counter-clockwise direction 70, the fluid nozzle needle 52 moves in direction 72 sealing the fluid nozzle 24 and blocking further fluid flow.

An air supply assembly 71 is also disposed in the electrostatic tool 12, enabling atomization at the spray tip assembly 22, with compressed air from the air supply 16. The illustrated air supply assembly 71 extends from an air inlet 73 to the spray tip assembly 22 through an air passage 74 to the air atomization cap 26. The air passage 74 includes multiple air passages including a main air passage 76, an electric generator air passage 78, an atomization air passage 122 (seen in FIG. 2), and a shaping air passage 120 (seen in FIG. 2). As mentioned above, the valve assembly 50 controls fluid and air flow through the electrostatic tool 12 through movement of the trigger 64. As the trigger 64 rotates in a clockwise direction 66, the trigger 64 opens the air valve 56. More specifically, rotation of the trigger 64 in the clockwise direction 66 induces movement of the air valve 56 in direction 68 through movement of the air valve needle 55. As the air valve 56 moves in direction 68, the air valve 56 unseats from the sealing seat 80, enabling air to flow from the main air passage 76 into an air plenum 82. The air plenum 82 communicates with and facilitates airflow from the main air passage 76 into the electric generator air passage 78, the atomization air passage 122 (seen in FIG. 2), and the shaping air passage 120 (seen in FIG. 2). In contrast, when the trigger 64 rotates in a counter-clockwise direction 70, the air valve 56 moves in direction 72 resealing with the sealing seat 80. Once the air valve 56 reseals with the sealing seat 80, air is unable to travel from the air supply 16 through the main air passage 76 and into the air plenum 82, for distribution into electric generator air passage 78, the atomization air passage 122 (seen in FIG. 2), and the shaping air passage 120 (seen in FIG. 2). Accordingly, activation of the trigger 64 enables simultaneous liquid and airflow to the spray tip assembly 22. Indeed, once an operator pulls the trigger 64, the valve assembly 50 moves in direction 68. The movement of the valve assembly 50 in direction 68 induces the fluid nozzle needle 52 to retract from the fluid nozzle 24, enabling fluid to enter the fluid nozzle 24. Simultaneously, movement of the valve assembly 50 induces the air valve 56 to unseat from the sealing seat 80, enabling air flow through the main air passage 76 and into the air plenum 82. The air plenum 82 then distributes the air for use by the spray tip assembly 22 (i.e., to shape and atomize), and by the power assembly 84.

The power assembly 84 includes an electric generator 86, a cascade voltage multiplier 88, and an ionization needle 90. As explained above, the air plenum 82 enables air flow to distribute into an electric generator air passage 78. The electrical generator air passage 78 directs airflow 79 from the air plenum 82 back through the handle 18 and into contact with a turbine (e.g., a rotor having a plurality of blades) or fan 92. The airflow induces the turbine 92 to rotate a shaft 94, which in turn rotates the electric generator 86. The electrical generator 86 converts the mechanical energy from the rotating shaft 94 into electrical power for use by the cascade voltage multiplier 88. The cascade voltage multiplier 88 is an electrical circuit, which converts low voltage alternating current (AC) from the electrical generator 86 into high voltage direct current (DC). The cascade voltage multiplier 88 outputs the high voltage direct current to the ionization needle 90, which then creates an ionization field 96 for electrically charging atomized liquid sprayed by the electrostatic tool 12.

As explained above, the electrostatic tool system 8 includes the electrostatic activation system 10 enabling the electrostatic tool 12 to spray coating material in an electrically charged mode and in an uncharged mode by connecting or disconnecting the electrical generator 86 from the cascade voltage multiplier 88. For example, the electrostatic activation system 10 may include a Reed switch 100 that connects and disconnects the electrical generator 86 from the cascade voltage multiplier 88. As will be explained in more detail below, the Reed switch 100 may complete an electric circuit in presence of a magnetic field and disconnect the electric circuit in the absence of a magnetic field. When the electrostatic activation system 10 connects the electrical generator 86 to the cascade voltage multiplier 88, the electrostatic tool 12 electrically charges the coating material while spraying. However, when the electrostatic activation system 10 disconnects the electrical generator 86 from the cascade voltage multiplier 88, the electrostatic tool 12 can continue to spray coating material, but is unable to charge the coating material. Accordingly, the electrostatic activation system 10 enables an operator to selectively apply or not apply an electric charge while spraying a coating material. For example, an operator may spray a target with an electrically charged coating material, but can stop charging the coating material to spray specific areas of the target unfavorable to electrostatic spraying (e.g., corners).

Figure 2:
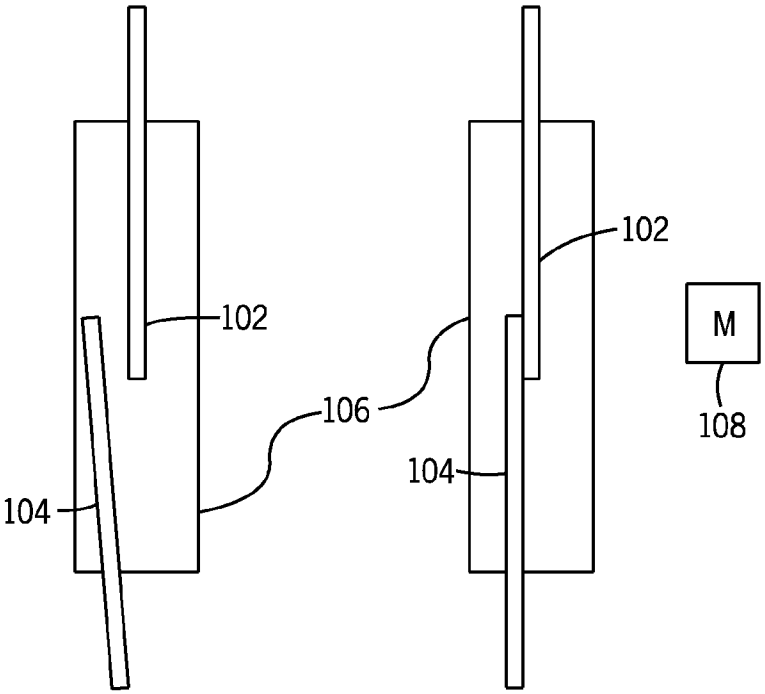
FIG. 2 is a cross-sectional view of a Reed switch according to an embodiment.

FIG. 2 is a cross-sectional view of the Reed switch 100. The Reed switch 100 includes electrical wires 102 and 104 partially enclosed within a hermetically sealed container 106. The electrical wires 102 and 104 are formed from stiff material and are placed within the container 106 in such way as to avoid contact. The wires 102 and 104 remain separated from one another until exposed to a magnetic field. In a magnetic field, the wires 102 and 104 attract one another, which bring the wires 102 and 104 into contact. When the wires 102 and 104 touch, they complete an electrical circuit enabling electrical power to travel through the wires 102 and 104. Moreover, after removing the magnetic field, the wires 102 and 104 separate from one another to block the flow of electrical power through the Reed switch 100. In the electrostatic tool system 8, when the Reed switch 100 closes (i.e., wires 102 and 104 contact one another), the electrical generator 86 supplies power to the cascade voltage multiplier 88 for charging the coating material. However, when the Reed switch 100 opens (i.e., wires 102 and 104 separate), the Reed switch 100 blocks the flow of electrical power from the electrical generator 86 to the cascade voltage multiplier 88, which blocks the electrostatic tool 12 from charging the coating material. In other embodiments, electrical power may be supplied by a battery, external power, a capacitor, etc.

Figures 3, 4, 5:
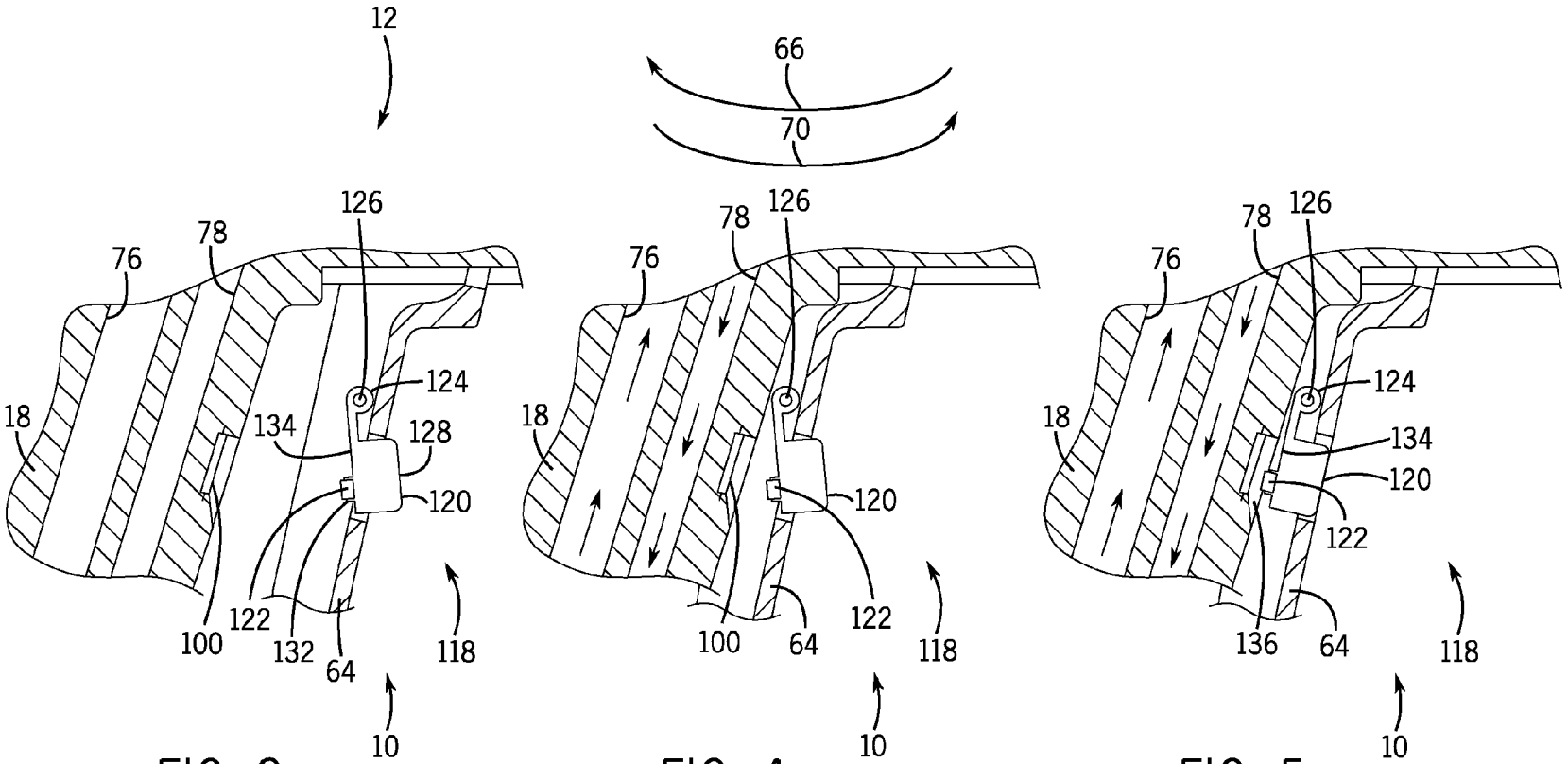
FIG. 3 is a partial cross-sectional side view of an embodiment of an electrostatic tool system with an electrostatics activation system, taken along line 3-3 of FIG. 1.
FIG. 4 is a partial cross-sectional side view of an embodiment of an electrostatic tool system with an electrostatics activation system, taken along line 3-3 of FIG. 1.
FIG. 5 is a partial cross-sectional side view of an embodiment of an electrostatic tool system with an electrostatics activation system, taken along line 3-3 of FIG. 1.

FIG. 3 is a partial cross-sectional side view of an electrostatic tool 12 with an electrostatics activation system 10. The electrostatics activation system 10 enables an operator to selectively apply or not apply an electric charge to a coating material while spraying. The electrostatics activation system 10 includes a Reed switch 100 and an electrostatics activation mechanism 118. In other embodiments, electrostatic activation system 10 may use an optical switch, toggle switch, push button switch, slider switch, etc. The electrostatics activation device 118 includes an electrostatics trigger 120, a magnet 122, and a torsional spring 124. A pin 126 couples the electrostatics trigger 120 and the spring 124 to the trigger 64, thereby enabling the electrostatics trigger 120 to rotate clockwise and counterclockwise in directions 66 and 70. Moreover, the attachment of the electrostatics trigger 120 to the trigger 64 with the pin 126 enables the electrostatics trigger 120 to rotate independently of the trigger 64. In other embodiments, the electrostatics trigger 120 may be in a nested arrangement with the electrostatics trigger 120 with the trigger 120 coupled to the electrostatic tool 12 but extending through the trigger 64. When the electrostatics activation system 10 is in an inactive state, the torsional spring 126 biases the trigger 120 in the counter-clockwise direction 70. In the inactive state, a front portion 128 of the electrostatics trigger 120 projects through a trigger aperture 130 in the trigger 64. Opposite the front portion 128 is a protrusion 132 in a back portion 134 of the trigger 120. The protrusion 132 includes an aperture 136 that receives the magnet 122 for coupling the magnet 122 to the electrostatics activation system 10. The magnet 122 may be press fit, glued, or fastened to couple the magnet 122 to the electrostatics trigger 120. In other embodiments, the entire electrostatics trigger 120 may be made out of a magnetic material.

In FIG. 3, neither the trigger 64 nor the electrostatics trigger 102 is depressed, which blocks compressed air and the coating material from flowing through the electrostatic tool 12. However, when an operator depresses the trigger 64, compressed air and coating material flows through and is sprayed by the electrostatic tool 12. As explained above, the flow of compressed air through the electrostatic tool 12 enables the electrical generator 86 to produce power for use in applying a charge to the coating material. An operator may then depress the electrostatics trigger 120 to activate the electrostatics and charge the coating material while spraying. Depressing the electrostatics trigger 120 brings the magnet 122 into proximity with the Reed switch 100 resting in the handle 18. The proximity of the magnet 122 to the handle 18 closes the Reed switch 100, enabling electrical power to flow from the electrical generator 86 to the cascade voltage multiplier 88. However, when the operator releases the electrostatic trigger 120, the spring 124 rotates the electrostatics trigger 120 in the counter clockwise direction 70 away from the handle 18. As the magnet 122 rotates away from the handle 18, the Reed Switch 100 opens and blocks the flow of electrical power from the electrical generator 86 to the cascade voltage multiplier 88. Accordingly, an operator may selectively add or remove electrical charge while spraying, by depressing and releasing the electrostatic trigger 120.

FIG. 4 is a partial cross-sectional side view of an electrostatic tool system 8 with the electrostatics activation system 10 in an inactive state. In FIG. 4, the trigger 64 is depressed and rotated in the counterclockwise direction 66 towards the handle 18. As explained above, rotation of the trigger 64 in counterclockwise direction 66 enables the electrostatic tool 12 to spray coating material by releasing compressed air and coating material to flow through the electrostatic tool 12. However, the electrostatic tool 12 will not electrically charge the coating material when spraying, because the electrostatic activation system 10 is inactive. Specifically, until an operator depresses the electrostatics trigger 120 to rotate the magnet 122 into proximity with the Reed switch 100, the Reed switch 100 will remain open and block the electrical power from traveling through the electrostatic tool 12.

FIG. 5 is a partial cross-sectional side view of an electrostatic tool system 8 with the electrostatics activation system 10 in an inactive state. In FIG. 5, the trigger 64 and the electrostatics trigger 120 are depressed and rotated in the counterclockwise direction 66 towards the handle 18. As explained above, rotation of the trigger 64 in the counterclockwise direction 66 enables the electrostatic tool 12 to spray coating material by releasing compressed air and coating material to flow through the electrostatic tool 12. Moreover, as the electrostatics trigger 120 rotates in the counterclockwise direction 66, the magnet 122 approaches and closes the Reed switch 100, enabling power to flow through the electrostatic tool 12 to charge the coating material while spraying. Specifically, the trigger 120 rotates in the clockwise direction 66, thereby moving the magnet 122 into a gap 136. The close proximity of the magnet 122 to the Reed switch 100 enables the magnetic field to close the Reed switch 100. However, an operator may periodically desire to spray uncharged coating material. An operator may therefore continue spraying coating material by depressing the trigger 64, but release the trigger 120 to stop the flow of electric power through the electrostatic tool 12. The release of trigger 120 enables the spring 124 to rotate the trigger 120 in the clockwise direction 70, thereby moving the magnet 122 away from the Reed switch 100. As the magnet 122 moves away from the Reed switch 100, the Reed switch 100 opens and blocks electrostatic charging of the coating material. Accordingly, the electrostatics activation system 10 enables an operator to selectively alternate between spraying electrically charged coating material and spraying electrically uncharged coating material.

Figures 6, 7, 8:
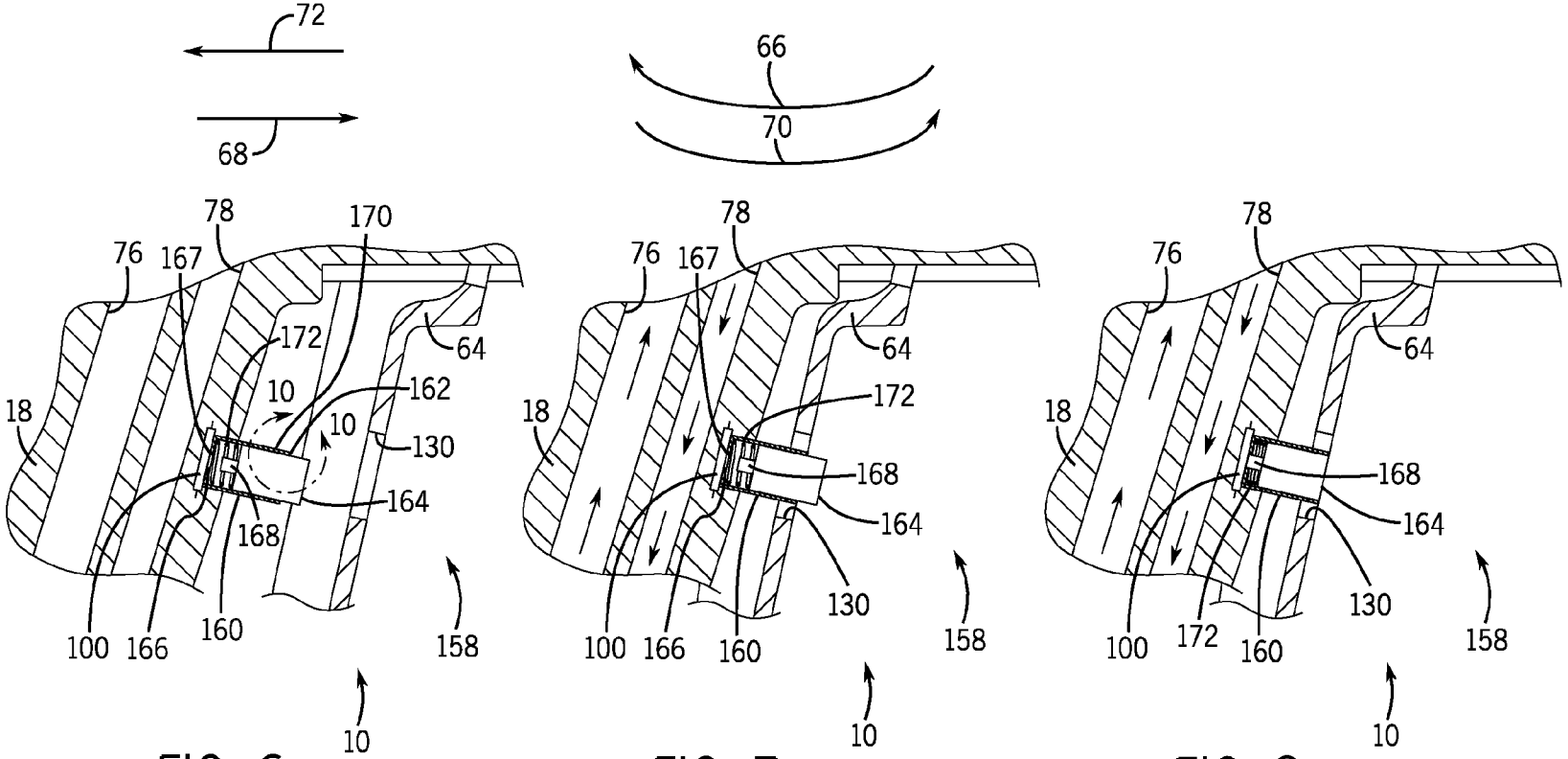
FIG. 6 is a partial cross-sectional side view of an embodiment of an electrostatic tool system with an electrostatics activation system, taken along line 3-3 of FIG. 1.
FIG. 7 is a partial cross-sectional side view of an embodiment of an electrostatic tool system with an electrostatics activation system, taken along line 3-3 of FIG. 1.
FIG. 8 is a partial cross-sectional side view of an embodiment of an electrostatic tool system with an electrostatics activation system, taken along line 3-3 of FIG. 1.

FIG. 6 is a partial cross-sectional side view of an electrostatic tool 12 with an electrostatics activation system 10. The electrostatics activation system 10 enables an operator to selectively apply an electric charge to a coating material while spraying. In FIG. 6, the electrostatics activation system 10 includes an electrostatics activation mechanism 158. The electrostatics activation mechanism includes an outer casing 160 that couples to the handle 18. The outer casing 160 may be part of, welded to, or threaded into the handle 18. The outer casing 160 includes a first aperture 162 that receives a plunger 164. Opposite the first aperture 162 is a second aperture 166 in an annular wall 167. The second aperture 166 enables a magnet 168 to activate the Reed switch 100 by passing through the annular wall 167 of the casing 160. However, the annular wall 167 blocks movement of the plunger 164 through the aperture 166. The electrostatics activation system 10 may include a gasket 170 between the plunger 164 and the casing 160. The gasket 170 forms a seal between the casing 160 and the plunger 164, such that the gasket 170 blocks the flow of fluids and materials through the outer casing 160. The magnet 168 may couple to the plunger 164 and extend partially through a spring 172 that rests within the outer casing 160 between the annular wall 167 and the plunger 164. In other embodiments, the magnet 168 may be replaced with an electrically conductive material that fills a space between conductive wires to complete an electrical circuit. In these embodiments, the gasket 170 blocks the flow of fluids and material that may interfere with or short an electrical connection in the electrostatics activation system 10.

In FIG. 6, the electrostatic tool 12 and the electrostatics activation system 10 is inactive. More specifically, neither the trigger 64 nor the plunger 164 is depressed, which blocks the electrically charging and spraying of coating material through the electrostatic tool 12. However, when an operator depresses trigger 64, the electrostatic tool begins spraying an uncharged coating material and enables the electrostatic activation system 10 to pass through the trigger aperture 130. As explained above, the flow of compressed air through the electrostatic tool 12 enables the electrical generator 86 to produce power for use in applying a charge to the coating material. After depressing the trigger 64, an operator may depress the plunger 164 to apply electrical charge to the coating material while spraying. Depressing the plunger 164 axially moves the plunger 164 and the magnet 168 in direction 72 and into proximity with the Reed switch 100 resting in the handle 18. The proximity of the magnet 168 to the Reed switch 100 enables electrical power to flow from the electrical generator 86 to the cascade voltage multiplier 88. However, when the operator releases the plunger 164, the spring 172 axially biases the magnet 168 in direction 68 away from the Reed switch 100. As the magnet 168 moves in direction 68, the Reed Switch 100 opens and again blocks the flow of electrical power from the electrical generator 86 to the cascade voltage multiplier 88. Accordingly, an operator may selectively add or remove electrical charge while spraying by depressing and releasing the plunger 164.

FIG. 7 is a partial cross-sectional side view of an electrostatic tool system 8 with the electrostatics activation system 10 in an inactive state. In FIG. 7, the trigger 64 is depressed and rotated in the counterclockwise direction 66 towards the handle 18. As explained above, rotation of the trigger 64 in counterclockwise direction 66 enables the electrostatic tool 12 to spray coating material by releasing compressed air and coating material to flow through the electrostatic tool 12. However, the electrostatic tool 12 will not electrically charge the coating material when spraying, because the electrostatic activation system 10 is inactive. Specifically, until an operator depresses the plunger 164, axially moving the magnet 168 into proximity with the Reed switch 100, the Reed switch 100 will remain open, blocking the electrical power from traveling through the electrostatic tool 12.

FIG. 8 is a partial cross-sectional side view of an electrostatic tool system 8 with the electrostatics activation system 10 in an active state. In FIG. 8, the trigger 64 and the plunger 164 are respectively depressed towards the handle 18. As explained above, rotation of the trigger 64 in the counterclockwise direction 66 enables the electrostatic tool 12 to spray coating material by releasing compressed air and coating material to flow through the electrostatic tool 12. Moreover, as the plunger 164 axially moves in direction 72, the magnet 168 approaches and closes the Reed switch 100, enabling power to flow through the electrostatic tool 12, which charges the coating material while spraying. Specifically, the plunger 164 moves in axial direction 72 enabling the magnet 168 to extend through aperture 166. The close proximity of the magnet 168 to the Reed switch 100 enables the magnetic field to close the Reed switch 100. However, during spraying operations, it may be desirable to spray uncharged coating material. An operator may therefore continue spraying the coating material by depressing the trigger 64, but selectively release the plunger 164 to stop the flow electric power through the electrostatic tool 12. The release of plunger 164 enables the spring 172 to axial move the magnet 168 and plunger 164 in direction 68 away from the Reed switch 100, which will open the Reed switch 100. Accordingly, the electrostatics activation system 10 enables an operator to selectively alternate between spraying electrically charged coating material and spraying electrically uncharged coating material.

Figure 9:
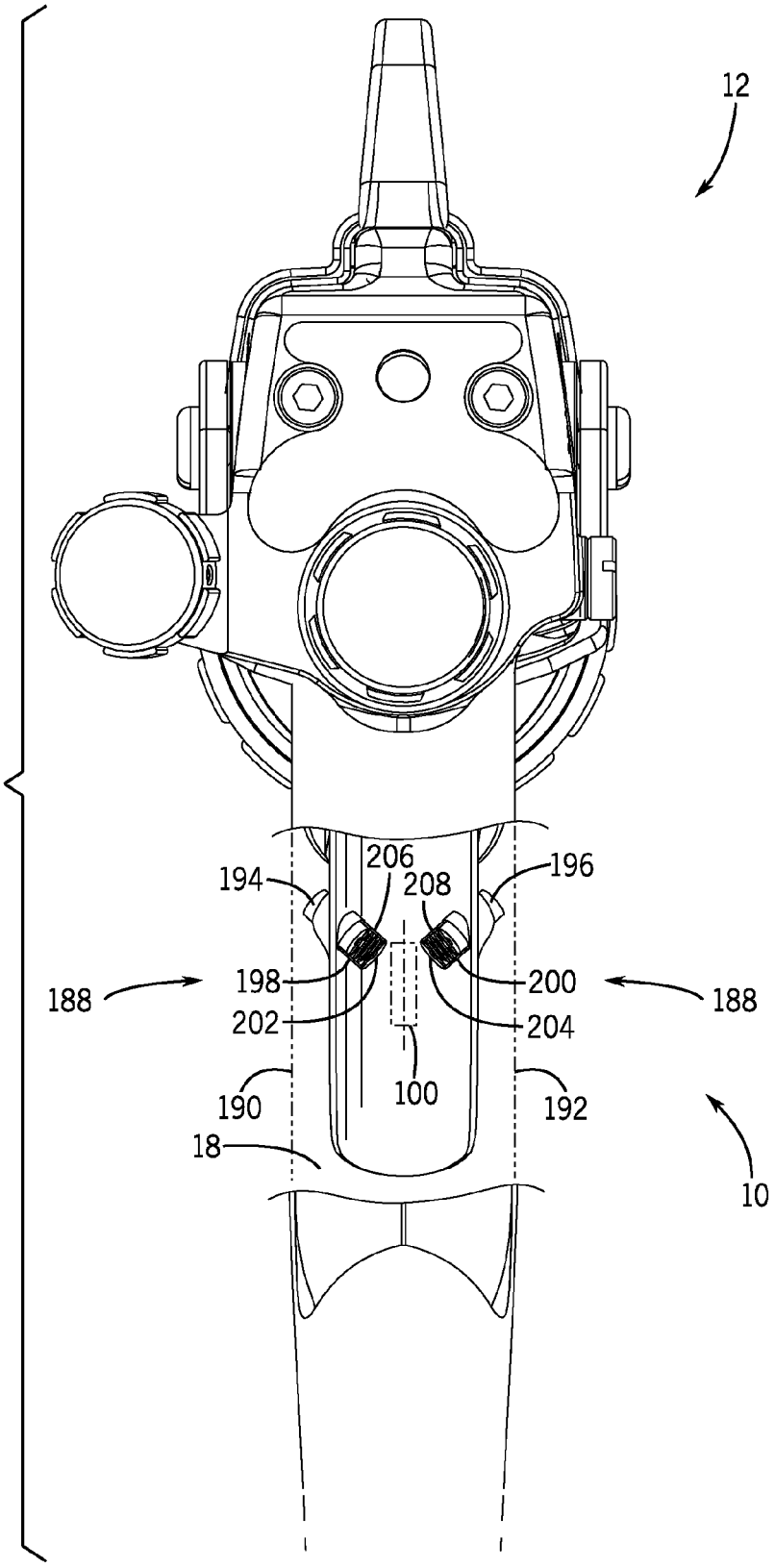
FIG. 9 is a partial rear cross-sectional view of an embodiment of an electrostatic tool system having an electrostatic activation system.

FIG. 9 is a partial rear cross-sectional view of an electrostatic tool 12 with an electrostatic activation system 10. In FIG. 9, the electrostatic activation system 10 includes two electrostatics activation mechanisms 188 on respective sides 190 and 192 of the handle 18. The electrostatics activation mechanisms 188 enable an operator to close a Reed switch 100. The inclusion of two electrostatics activation mechanisms 188 enables left-handed and right-handed operators to use one kind of electrostatic tool 12. As explained above with respect to the electrostatics activation mechanism 158, the plungers 194 and 196 axially move within their respective outer casings 198 and 200. As the plungers 194 and 196 move axially, the plungers 194 and 196 move respective magnets 202 and 204 into proximity with the Reed switch 100 resting in the handle 18. The proximity of either magnet 202 or 204 to the Reed switch 100 closes the Reed switch 100, enabling electrical power to flow from the electrical generator 86 to the cascade voltage multiplier 88. However, when the operator releases the plungers 194 or 196, the springs 206 and 208 axially bias the magnets 202 and 204 away from the Reed switch 100. As the magnets 202 and 204 move away from the Reed switch 100, the Reed Switch 100 opens and again blocks the flow of electrical power from the electrical generator 86 to the cascade voltage multiplier 88. Accordingly, an operator may selectively add or remove electrical charge while spraying by depressing and releasing either plunger 194 or 196 located on the sides 190 and 192 of the handle 18.

Figure 10:
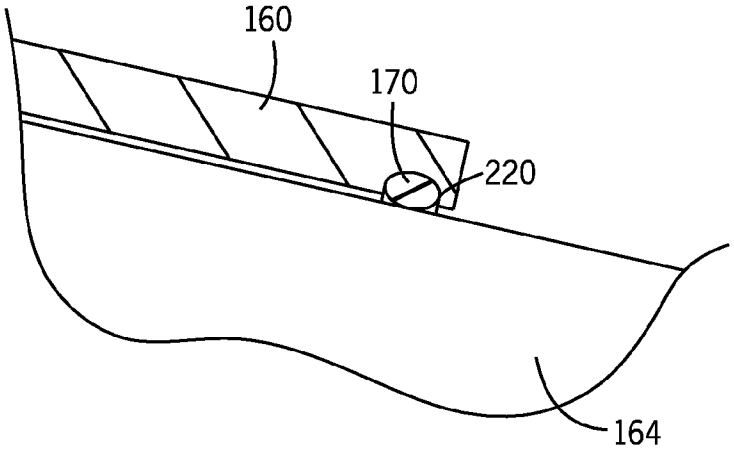
FIG. 10 is a partial cross-sectional view of an embodiment of an electrostatic activation system taken along line 10-10 of FIG. 6.

FIG. 10 is a partial cross-sectional view of an electrostatic activation system 10 along line 10-10 in FIG. 6. As illustrated, a gasket 170 may rest between the outer casing 160 and the plunger 164. An aperture 220 in the outer casing 160 may receive the gasket 170 to hold the gasket 170 in place. Alternatively, the gasket 170 may rest within an aperture in the plunger 164. The gasket 170 provides a fluid tight seal between the plunger 164 and the outer casing 160 to block the flow of fluid or other material from entering the electrostatic activation system 10.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system, comprising:

an electrostatic tool comprising:

a handle;

a first trigger configured to move between a first trigger position and a second trigger position, wherein the electrostatic tool is configured to block a fluid flow in the first trigger position, and the electrostatic tool is configured to enable the fluid flow in the second trigger position to apply a coating material; and an electrostatic activation system comprising a second trigger configured to selectively activate and deactivate electrical charging of the coating material, wherein the second trigger is disposed along the first trigger;

wherein the electrostatic tool comprises at least one of: the first and second triggers are directly coupled together, or the first and second triggers are disposed in a nested arrangement, or the first and second triggers have separate user contact surfaces, or a combination thereof.

2. The system of claim 1, wherein the second trigger is configured to close a switch by moving between a first electrostatic position away from the handle and a second electrostatic position towards the handle.

3. The system of claim 2, wherein the second trigger couples to the first trigger and is configured to move independently of the first trigger.

4. The system of claim 3, wherein the switch is a reed switch and the second trigger comprises a magnet, and the second trigger is configured to activate the reed switch with the magnet when the second trigger is in the second electrostatic position.

5. The system of claim 1, wherein the handle includes a handle aperture exposing a reed switch.

6. The system of claim 1, wherein the electrostatic activation system comprises a plunger configured to move axially within a casing.

7. The system of claim 6, wherein the plunger is configured to move a magnet between a first electrostatic position that activates a reed switch and a second electrostatic position that deactivates the reed switch.

8. The system of claim 7, wherein the plunger is configured to extend through a trigger aperture in the first trigger when the first trigger is in the second position.

9. The system of claim 8, wherein the casing does not extend through the trigger aperture of the first trigger.

10. The system of claim 6, wherein a spring is configured to move the plunger from the first electrostatic position to the second electrostatic position.

11. The system of claim 6, wherein the casing is coupled to the handle.

12. The system of claim 1, wherein the first and second triggers are directly coupled together.

13. The system of claim 1, wherein the first and second triggers are disposed in the nested arrangement.

14. The system of claim 13, wherein the nested configuration has the second trigger extending at least partially through a trigger aperture in the first trigger.

15. The system of claim 1, wherein the first and second triggers have separate user contact surfaces.

16. A system, comprising:

a trigger assembly configured to couple to an electrostatic tool, wherein the trigger assembly comprises:

a first trigger configured to move between a first trigger position and a second trigger position, wherein the first trigger position is configured to control the electrostatic tool to block a fluid flow, and the second trigger position is configured to control the electrostatic tool to enable the fluid flow to apply a coating material; and a second trigger configured to selectively activate and deactivate electrical charging of the coating material via an electrostatic system, wherein the second trigger is disposed along the first trigger;

wherein the electrostatic tool comprises at least one of: the first and second triggers are directly coupled together, or the first and second triggers are disposed in a nested arrangement, or the first and second triggers have separate user contact surfaces, or a combination thereof.

17. The system of claim 16, wherein the first and second triggers are directly coupled together.

18. The system of claim 16, wherein the first and second triggers are disposed in the nested arrangement.

19. The system of claim 18, wherein the nested configuration has the second trigger extending at least partially through a trigger aperture in the first trigger.

20. The system of claim 16, wherein the first and second triggers have separate user contact surfaces.

21. A system, comprising:

an electrostatic tool comprising:

a handle;

a first trigger configured to move between a first trigger position and a second trigger position, wherein the electrostatic tool is configured to block a fluid flow in the first trigger position, and the electrostatic tool is configured to enable the fluid flow in the second trigger position;

an electrostatic activation system comprising a second trigger configured to activate and deactivate electrical charging of the coating material, wherein the second trigger is disposed along the first trigger, and the first and second triggers are configured to be user actuated independent from one another.

22. The system of claim 21, wherein the second trigger comprises a plunger that extends through a trigger aperture in the first trigger when the first trigger is in the second trigger position.

23. The system of claim 22, wherein the plunger is configured to move a magnet between a first electrostatic position that activates a reed switch and a second electrostatic position that deactivates the reed switch.

24. The system of claim 21, wherein the second trigger includes a first plunger and a second plunger on opposite sides of the handle.

* * * * *